United States Patent [19]

Fujimori

[11] Patent Number: 4,779,595

[45] Date of Patent: Oct. 25, 1988

[54] APPARATUS FOR CONTROLLING IDLING OPERATION OF INTERNAL COMBUSTION ENGINE

[75] Inventor: Kyoichi Fujimori, Higashimatsuyama, Japan

[73] Assignee: Diesel Kiki Co., Ltd, Tokyo, Japan

[21] Appl. No.: 943,113

[22] Filed: Dec. 18, 1986

[30] Foreign Application Priority Data

Dec. 28, 1985 [JP] Japan ..... 60-293570

[51] Int. Cl.[4] ..... F02D 41/38

[52] U.S. Cl. ..... 123/436; 123/357

[58] Field of Search ..... 123/436, 419, 357; 364/431.08

[56] References Cited

U.S. PATENT DOCUMENTS

| | | | |
|---|---|---|---|
| 4,495,920 | 1/1985 | Matsumura et al. | 123/436 |
| 4,502,438 | 3/1985 | Yasuhara | 123/494 |
| 4,539,956 | 9/1985 | Hengel et al. | 123/436 |
| 4,616,617 | 10/1986 | Geiger et al. | 123/436 |
| 4,667,634 | 5/1987 | Matsumura et al. | 123/436 |

FOREIGN PATENT DOCUMENTS

| | | | |
|---|---|---|---|
| 59-82534 | 5/1984 | Japan | 123/436 |
| 59-221434 | 12/1984 | Japan | 123/436 |
| 60-1338 | 1/1985 | Japan | 123/436 |

*Primary Examiner*—Andrew M. Dolinar

*Attorney, Agent, or Firm*—Pollock, Vande Sande & Priddy

[57] ABSTRACT

In an idling operation controlling apparatus for performing an individual cylinder control of a multi-cylinder internal combustion engine, individual cylinder control data is corrected only during a predetermined period in accordance with a predetermined parameter relating to the state of the control of the amount of fuel injection of the internal combustion engine, in such a way that the time period required for the regulation of the injection quantity for each cylinder to reach a desired state is shortened, thus the response characteristic of the individual cylinder control system can be improved.

20 Claims, 6 Drawing Sheets

TQi

N

TDC

NLP

TS

TDCTR

Nin

Δ Nin (CALCULATION)

(OUTPUT)
ANGLE OF CRANKSHAFT [°CA]
0
180
360
540
720
900

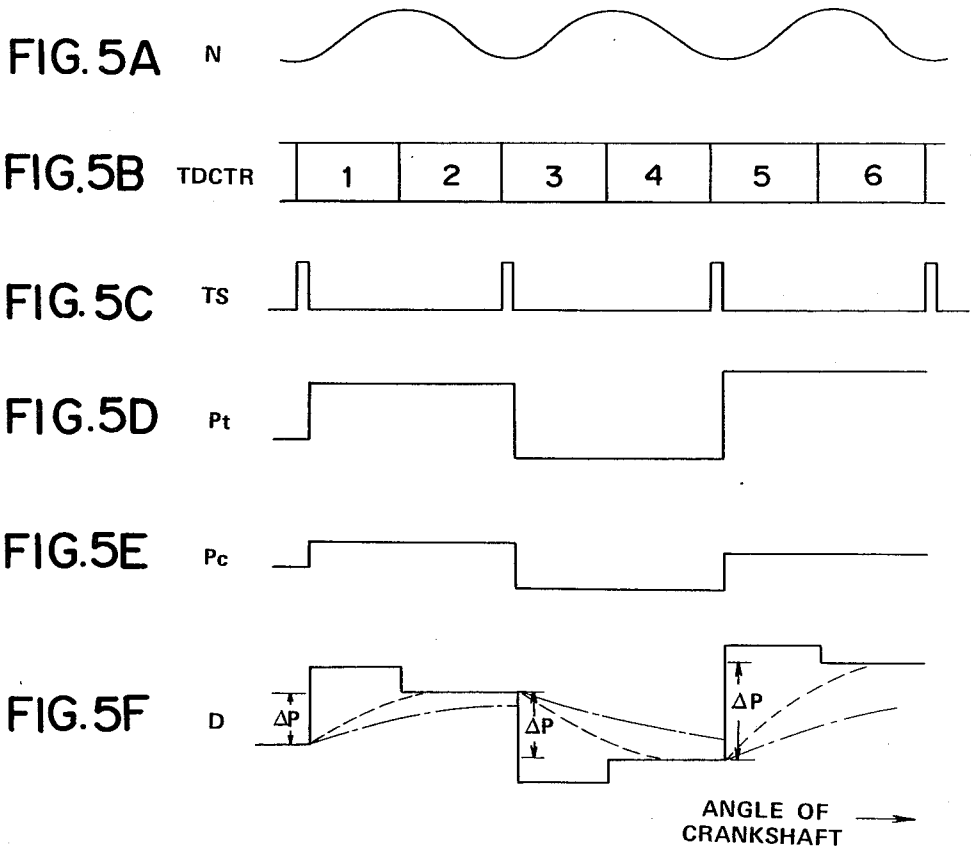
FIG.5A FIG.5B FIG.5C FIG.5D FIG.5E FIG.5F
FIG.7
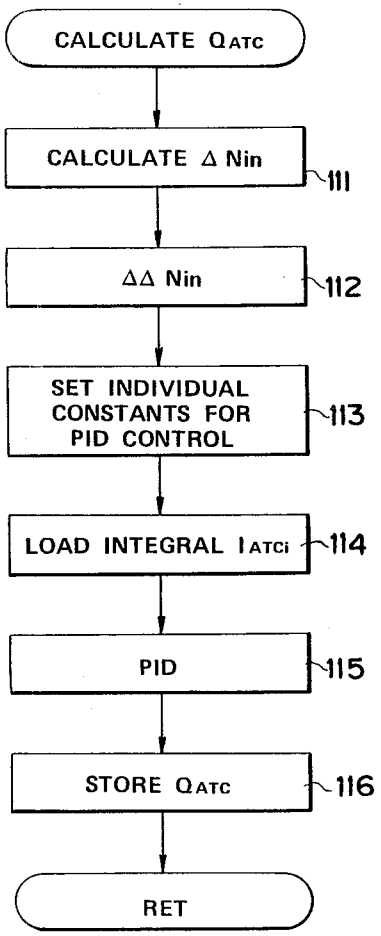

APPARATUS FOR CONTROLLING IDLING OPERATION OF INTERNAL COMBUSTION ENGINE

BACKGROUND OF THE INVENTION

The present invention relates to an apparatus for controlling the idling operation of an internal combustion engine, more particularly to an idling operation controlling apparatus for a multi-cylinder internal combustion engine for regulating the fuel supplied for each cylinder so as to minimize the dispersion in output among the respective cylinders thereby enabling stable control of the idling operation with good response characteristics.

In the conventional control system for controlling the amount of fuel injected from a fuel injection pump into a multi-cylinder internal combustion engine, the fuel injection amounts for the respective cylinders are uniformly controlled in common. Accordingly, uniform output cannot be obtained from the cylinders due to dimensional differences etc. within the manufacturing tolerance of the internal combustion engine and/or the fuel injection pump and the like. Non-uniform output of the cylinders causes especially pronounced degradation in the stability of the internal combustion engine during the idling operation of the engine, and this in turn increases the amount of harmful components included in the exhaust gas. Furthermore, such non-uniform output gives rise to engine vibration which in turn causes noise and other disadvantages.

In order to overcome the above problems, there have been proposed various apparatuses for controlling the fuel injected into the respective cylinders of the internal combustion engine according to an individual cylinder control method. Japanese Patent Application Public Disclosure No. 82534/84 discloses an example of an apparatus of this type in which individual cylinder control is carried out on the basis of the result of a detection carried out for every combustion stroke in each cylinder, of the difference between the rotational speed at the time of the combustion of fuel supplied by injection to the multi-cylinder internal combustion engine and the rotational speed at the time when the instantaneous rotational speed of the crankshaft reaches maximum value as a result of the above-mentioned combustion.

However, the conventional apparatuses of this type directly use the result of the individual cylinder control calculation as data for determining the target injection amount in idling operation control, making the response characteristics of the control system a problem in the case where the number of cylinders of the engine is great. The conventional apparatuses thus have the disadvantage that the individual cylinder control operation is hindered. More specifically, when the target idling speed is high or the number of cylinders is numerous, the time period from calculation and output of the target value of the amount of fuel injection for each cylinder to the actual fuel injection into that cylinder is shortened to such an extent that there is insufficient time for the servosystem to perform the operation for regulating the actual injection amount in response to the determination of the target value.

In order to overcome this disadvantage, it is effective to employ a method which lowers the frequency of the drive pulse signal of the governor system so as to increase the frequency response of the governor system. However, this method gives rise to other problems, e.g., a change in the output torque of the engine is caused even by a small vibration of the governor and the method can be implemented only by the use of bulky equipment.

SUMMARY OF THE INVENTION

It is an object of the present invention to provide an improved apparatus for controlling the idling operation of an internal combustion engine.

It is another object of the present invention to provide an apparatus for controlling the idling operation of an internal combustion engine which is capable of regulating the operation of controlling the amount of fuel injected to each cylinder of a multi-cylinder internal combustion engine with good response characteristics.

It is still another object of the present invention to provide an apparatus for controlling the idling operation of an internal combustion engine in which the control of fuel injection for each cylinder can be carried out well regardless of the number of cylinders of the internal combustion engine to be controlled.

According to the present invention, in an apparatus for controlling the idling operation of a multi-cylinder internal combustion engine which performs individual cylinder control to correct the scattering in output among the cylinders of the engine, the apparatus comprises a detecting means for detecting the operation timing of the internal combustion engine, a first calculating means for calculating and producing a first data relating to the output from each cylinder of the internal combustion engine, a second calculating means responsive to the first data for calculating and producing an individual cylinder control data related to the supply of fuel necessary for reducing to zero the difference between the output from each cylinder and the output from a reference cylinder which is predetermined for the respective cylinders, an output control means for controlling each output timing of the individual cylinder control data in response to the result of the detection in the detecting means in such a way that the individual cylinder control data is produced at a predetermined timing before the next fuel regulating process for the cylinder corresponding thereto, a correcting means for correcting the individual cylinder control data only during a predetermined period in accordance with a desired parameter relating to the state of control of the amount of fuel injection of the internal combustion engine, and a servo means responsive to the corrected individual cylinder control data for adjusting the fuel quantity to be supplied to the internal combustion engine.

The individual cylinder control data representing the fuel quantity for the respective cylinders necessary for making the output of all cylinders the same is output at a predetermined timing on the basis of the output of the detecting means. The individual cylinder control data is corrected by the correcting means in such a way that the content of the individual cylinder control data is increased or decreased only during a predetermined time period in accordance with a predetermined parameter relating to the state of control of the amount of fuel injection for the cylinders of the internal combustion engine. As a result, the time period required for the regulation of the amount of injection for each cylinder to reach a desired state is shortened and the response characteristic of the individual cylinder control system can be improved.

The invention will be better understood and other objects and advantages thereof will be more apparent from the following detailed description of preferred embodiments with reference to the accompanying drawings.

BRIEF DESCRIPTION OF THE DRAWINGS

FIGS. 5A to 5F are timecharts for explaining the improvement in the response characteristics of the control system by the correcting unit;

FIG. 7 is a detailed flowchart of a portion of the flowchart shown in FIG. 6.

DESCRIPTION OF THE PREFERRED EMBODIMENTS

Figure 1:
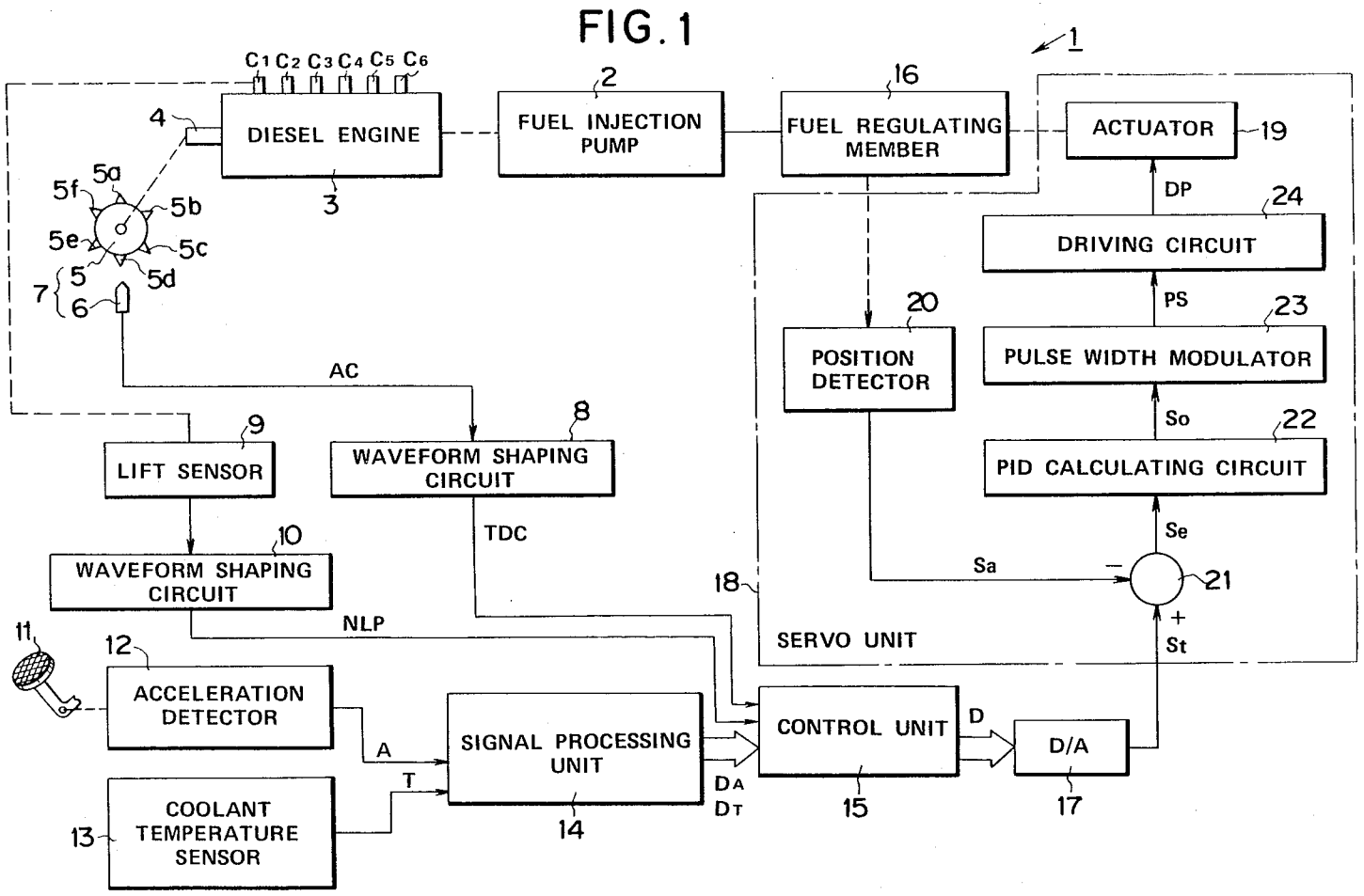
FIG. 1 is a block diagram of an embodiment of an idling operation control apparatus according to the present invention.

FIG. 1 is a block diagram of an embodiment of an idling operation control apparatus for an internal combustion engine according to the present invention. An idling operation control apparatus 1 serves to control the idling engine speed of a diesel engine 3 to which fuel is supplied from a fuel injection pump 2.

A well-known rotation sensor 7 consisting of a pulser 5 and an electromagnetic pick-up coil 6 is provided on a crankshaft 4 of the diesel engine 3. In this embodiment, the diesel engine 3 is of the 4-cycle, 6-cylinder type and has six cylinders $C_1$ to $C_6$.

FIGS. 2A to 2F show timecharts representing the fuel combustion timing and the magnitude of the output torque produced as a result of the combustion of fuel in the cylinders $C_l$ to $C_6$, respectively. The horizontal axis represents the crankshaft angle (°CA) where the fuel combustion start timing in the cylinder $C_l$ is zero degree. Since the diesel engine 3 in this embodiment is a 4-cycle 6-cylinder type, the next fuel combustion in cylinder $C_l$ starts at 720(°CA) and, in general, it follows that fuel combustion starts in the cylinders at intervals of 120(°CA), i.e., there is an interval of 120(°CA) between combustion in one cylinder and that in the next. In this embodiment, the combustion of fuel is carried out in the sequence $C_l$, $C_2$, $C_3$, $C_4$, $C_5$ and $C_6$. In whichver cylinder, the output torque rises up to 60(°CA) from the time of the start of fuel combustion while the output torque decreases after 60(°CA). The output torque becomes zero at a time when 180(°CA) has been reached where the combustion stroke in that cylinder has been completed. FIGS. 2A to 2F diagramatically illustrate the condition of the change in the output torque $TQ_l$ to $TQ_6$ from the cylinders $C_l$ to $C_6$, respectively. Moreover, the fuel combustion start timing of the individual cylinders may not always coincide precisely with the top dead center timing of the corresponding piston of the cylinder. However, for convenience of description, the combustion start timing will be assumed to coincide with the top dead center timing.

Figures 2A, 2B, 2C, 2D, 2E, 2F, 2G, 2H:
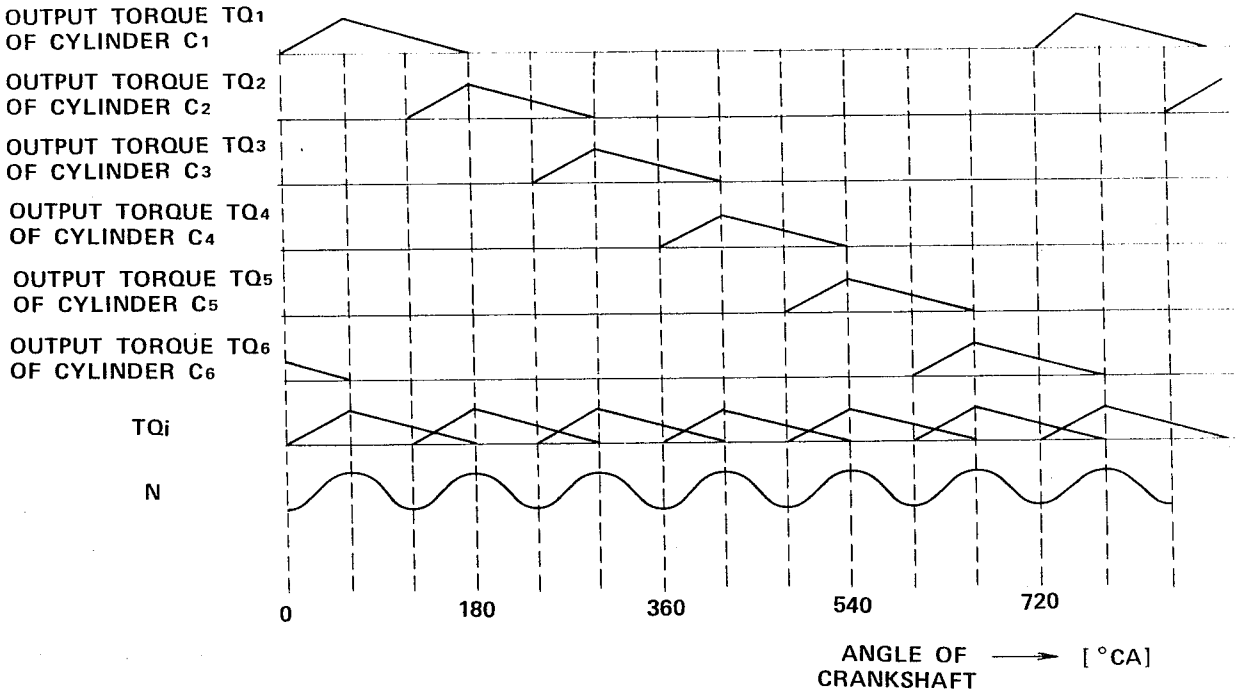
FIGS. 2A to 2H are timecharts for explaining the operating condition of the diesel engine shown in FIG. 1.

As a result of the output torque of the respective cylinders occuring as shown in FIGS. 2A to 2F, the instantaneous value $TQ_l$ of the torque output from the crankshaft 4 will be as shown in FIG. 2G and the instantaneous rotational speed N of the crankshaft 4 changes at a period of 120(°CA) as shown in FIG. 2H.

Referring back to FIG. 1, so as to enable the rotation sensor 7 to detect the timing at which the angular position of the crankshaft 4 of the diesel engine 3 reaches predetermined reference angular positions, a set of cogs, $5_a$ to $5_f$ is formed around the periphery of pulser 5, separated from each other by 60°. The pulser 5 is secured to the crankshaft 4 in such a way that one of the cogs $5_a$ to $5_f$ faces the electromagnetic pick-up coil 6 at each instant the crankshaft 4 reaches one of the predetermined angular positions. An output signal AC from the rotation sensor 7 is input to a waveform shaping circuit 8, from which is output a top dead center pulse signal TDC consisting of top dead center pulses indicating the top dead center timing of the pistons of the respective cylinders.

Figures 4A, 4B, 4C, 4D, 4E, 4F, 4G, 4H, 4I, 4J, 4K:
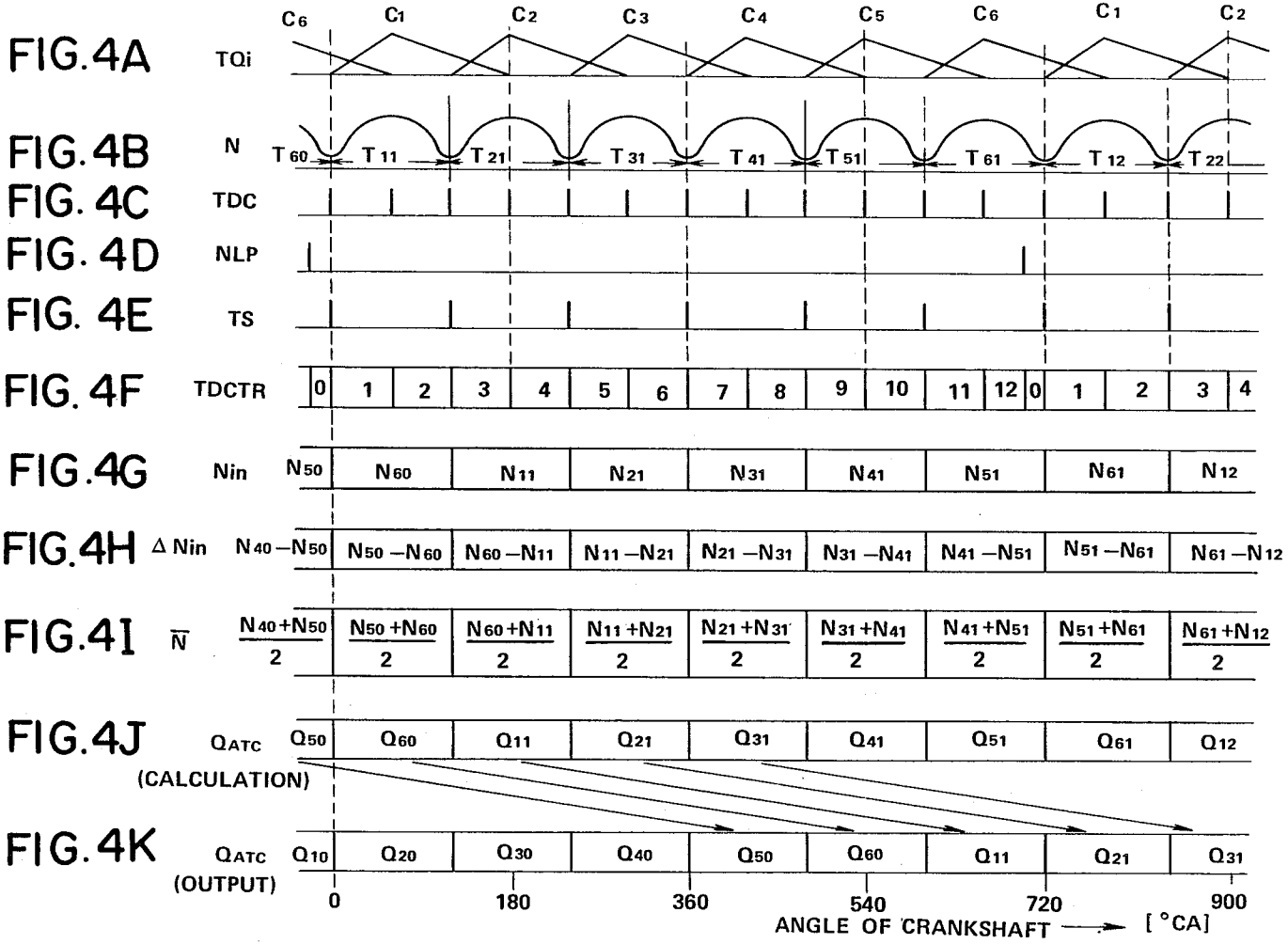
FIGS. 4A to 4K are timecharts for explaining the operation of the apparatus shown in FIG. 1 and FIG. 3.

FIGS. 4A and 4B show the instantaneous value $TQ_l$ of the torque output from the crankshaft 4 of the diesel engine 3 and the instantaneous rotational speed N of the crankshaft 4, respectively, whereas FIG. 4C shows the waveform of the top dead center pulse signal TDC. Among the pulses constituting the top dead center pulse signal TDC, those corresponding to the minimum points of the instantaneous rotational speed N represent the start timing of the fuel combustion in the respective cylinders.

In order to detect what sort of timing in which cylinder is represented by each pulse of the top dead center pulse signal TDC, a lift sensor 9 for detecting the needle valve lift timing of a fuel injection valve (not shown) is provided on the cylinder $C_l$. The output pulse generated from the lift sensor 9 is shaped into a waveform by a corresponding waveform shaping circuit 10, resulting in the output of a lift pulse signal NLP. The lift pulse signal NLP is output just before the beginning of the fuel combustion in cylinder $C_l$ at intervals of 720(°CA) as shown in FIG. 4D. The detection of the operation timing of the diesel engine 3 is carried out with reference to the lift pulse signal NLP and the top dead center pulse signal TDC as described below.

The apparatus 1 further comprises as acceleration detector 12 connected to an accelerator pedal 11 for detecting the amount of operation of the accelerator pedal 11 and producing an acceleration signal A indicating the amount of operation of the accelerator pedal 11. Numeral 13 denotes a coolant temperature sensor for detecting the coolant temperature of the diesel engine 3 and a coolant temperature signal T indicating the coolant temperature is produced from the coolant temperature sensor 13.

The acceleration signal A and the coolant temperature signal T are input to a signal processing unit 14 wherein the acceleration signal A and the coolant temperature signal T are changed into corresponding data $D_A$, $D_T$ in digital form and input to a control unit 15 to which the top dead center pulse signal TDC and the lift pulse signal NLP are also input. The control unit 15 is provided for calculating the amount of fuel injection for each of the cylinders necessary for smoothly operating the diesel engine 3 at a desired idling rotational speed. The operation for regulating the amount of fuel injected is carried out by a fuel regulating member 16 of the fuel injection pump 2, and the result of the calculation showing the desired injection amount for each cylinder calculated in the control unit 15 is output as control data D representing the position to which the fuel regulating member 16 is to be regulated. The control data D is converted into a position control signal $S_t$ corresponding to the control data D by a digital-analog (D/A) converter 17, and the position control signal $S_t$ is input into a servo unit 18 for controlling the position of the fuel regulating member 16.

The servo unit 18 has an actuator 19 connected to the fuel regulating member 16 and the feedback control of the position of the fuel regulating member 16 is carried out by the actuator 19 in response to the position control signal $S_t$. The servo unit 18 is also provided with a position detector 20 for producing an actual position signal indicating the actual regulated position of the fuel regulating member 16 at each instant. An actual position signal $S_a$ from the position detector 20 is added to the position control signal $S_t$ in an adeer 21 with the polarity as shown in FIG. 1. Consequently, the adder 21 outputs an error signal $S_e$ indicating the difference between the target position of the fuel regulating member 16 necessary for obtaining the predetermined amount of fuel injection calculated in the control unit 15 and the actual position thereof. The error signal $S_e$ is input to a PID (Proportional, Integral and Differential) calculating circuit 22 wherein a signal processing for PID control is carried out for the error signal $S_e$, and the output signal $S_o$ from the PID calculating circuit 22 is input to a pulse width modulator 23. The pulse width modulator 23 outputs a pulse signal PS whose duty ratio changes in correspondence to the level of the output signal $S_o$. The pulse signal PS is amplified to a level sufficient for driving the actuator 19 by a driving circuit 24 and the actuator 19 is driven by a driving pulse DP obtained as shown in the above.

The actuator 19 is operated by the driving pulse DP so as to adjust the position of the fuel regulating member 16 in the direction towards which the error signal $S_e$ is reduced to zero. As a result, a feedback control is carried out in such a way that the position of the fuel regulating member 16 is set in a suitable position indicated by the position control signal $S_t$.

Figure 3:
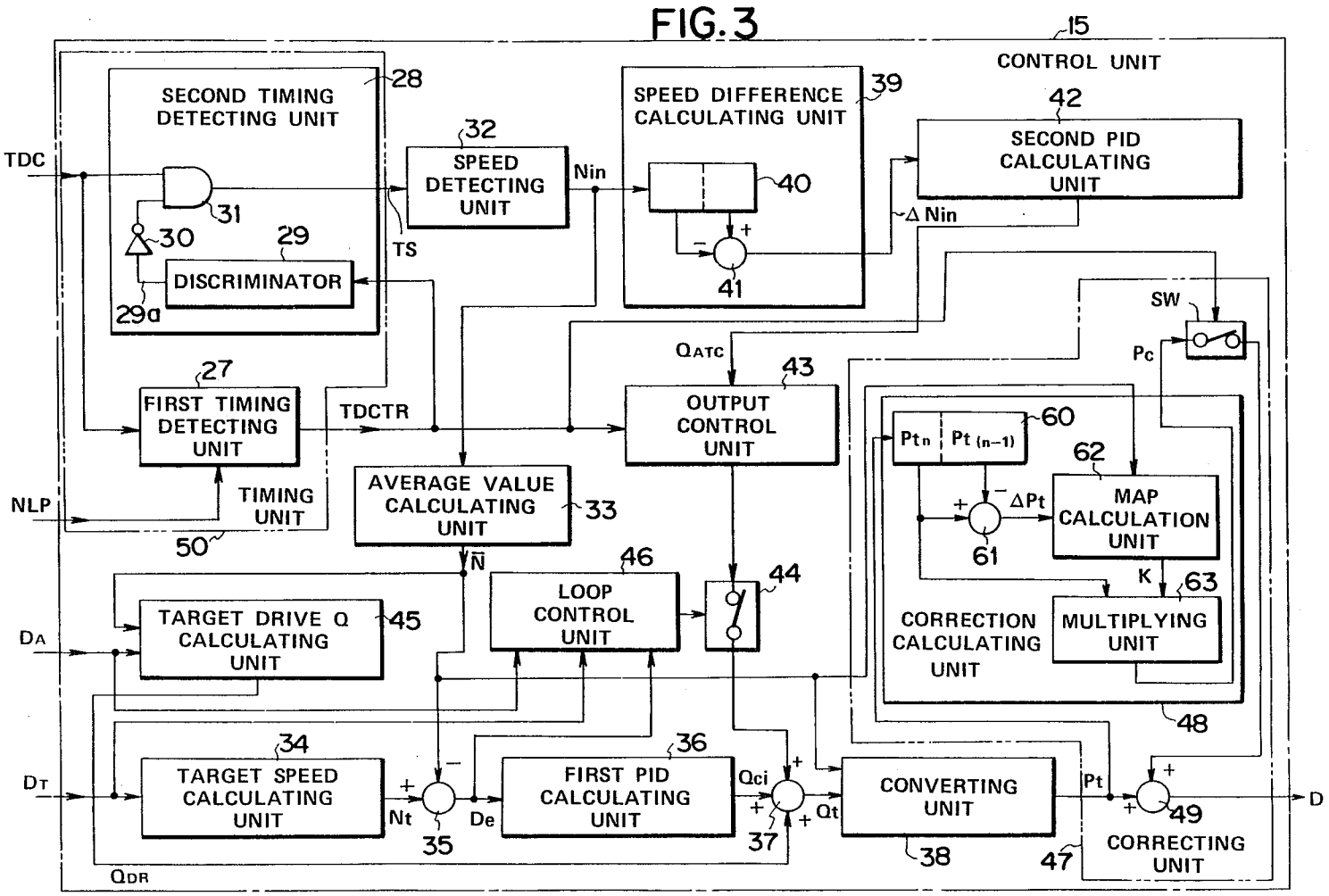
FIG. 3 is a detailed block diagram of the control unit shown in FIG. 1.

The following is a description with reference to FIG. 3 of the detailed constitution of the control unit 15 responsive to the various input signals mentioned above for calculating and outputting the control data D.

In order to detect the operation timing of the diesel engine 3, there is provided a timing unit 50 having a first timing detecting unit 27 which is a counter operating in response to the top dead center pulse signal TDC and the lift pulse signal NLP. The first timing deteting unit 27 is reset by the lift pulse signal NLP and has a counting function which increments at every input of a pulse of the top dead center pulse signal TDC. The result of the counting in the first detecting unit 27 is obtained as a count signal TDCTR. Consequently, the counted value of the count signal TDCTR changes as shown in FIG. 4F and the time period during which the instantaneous engine speed N changes from a minimum point to a maximum point and the time period during which the instantaneous engine speed N changes from a maximum point to a minimum point can be discriminated by whether the value of the count signal TDCTR is an even number or an odd number (see FIG. 4B).

The count signal TDCTR is supplied to a second timing detecting unit 28 for producing a timing signal for each cylinder determining a predetermined measurement period which includes at least that part of the period during which torque is produced due to fuel combustion in the cylinder concerned during which no influence arises because of torque produced in cylinders other than the cylinder concerned.

The second timing detecting unit 28 has a discriminator 29 responsive to the count signal TDCTR for discriminating whether the value of the count signal TDCTR is an even number or an odd number, and the discriminator 29 produces a high level signal on its output line $29_a$ when the value of the count signal TDCTR is an odd number. The output line $29_a$ is connected through an inverter 30 with one input terminal of an AND-gate 31 having another input terminal to which the top dead center pulse signal TDC is applied.

Therefore, the AND-gate 31 is opened only when the value of the count signal TDCTR is even or zero, so that only the pulses of the top dead center pulse signal TDC corresponding to the minimum points of the instantaneous engine speed N are allowed to pass through the AND-gate 31 and the pulses obtained through the AND-gate 31 are derived as a timing signal TS from the second timing detecting unit 28 (see FIG. 4E).

The timing signal TS is input to a speed detecting unit 32, wherein the times $T_{ll}$, $T_{21}$, $T_{31}$ . . . from the time at which the instantaneous engine speed N reached a minimum state to the time at which it reaches its next minimum state are measured based on the timing signal TS (see FIGS. 4B and 4E). The times $T_{ll}$, $T_{21}$, $T_{3l}$ . . . are related to the engine speed, that is, the output from the respective cylinders. The time period set for measuring the engine speed in the above-mentioned manner is determined on the basis of the state of TDCTR in such a way that it includes, of the period during which torque is produced due to fuel combustion in the cylinder concerned, at least that part during which no influence arises because of torque produced in cylinders other than the cylinder concerned.

In other words, when the time to be measured is $T_{ll}$, for example, the measurement period $\theta$ set for measuring this time $T_{ll}$ is for carrying out the measurement concerning the output from the cylinder $C_l$ and, of the total period (0(°CA) to 180(°CA)) during which torque is produced due to fuel combustion in cylinder $C_l$, includes only the period (60(°CA) to 120(°CA)) not influenced by torque produced in cylinders $C_6$ and $C_2$ and a period (0(°CA) to 60(°CA)) slightly influenced by the output from cylinder $C_6$. The time periods for measuring other times $T_{21}$, $T_{31}$. . . are similarly set. In this way, when the measurement periods are set so as to include all of the period during which there is no influence from the torque arising in other cylinders, but not to include all of the period during which there is influence from the torque arising in other cylinders, it is possible to obtain a time measurement which corresponds almost exactly to the output from the specific cylinder under consideration and also to obtain accurate information concerning the output from each of the cylinders.

Times $T_{ll}$, $T_{21}$, $T_{31}$, . . . obtained as forementioned represent the time required for the crankshaft 4 to rotate 120(°CA). An instantaneous speed data representing the instantaneous rotational engine speed corresponding to the output from each cylinder $C_i$ is calculated in the speed detecting unit 32 by the use of the times $T_{ll}$, $T_{21}$, $T_{31}$, . . . . The instantaneous speed data representing the instantaneous rotational engine speed for any given cylinder $C_i$ will be generally represented here in accordance with the sequence in which it was detected in the speed detecting unit 32 as $N_{in}$ (n=0, 1, 2, . . .).

Accordingly, the contents of the instantaneous speed data Nin output from the speed detecting unit 32 will be as shown in FIG. 4G.

The instantaneous speed data $N_{in}$ is input to an average value calculating unit 33 where the average speed of the diesel engine 3 is calculated, and an average speed data $\overline{N}$ indicating the average engine speed is produced. In this case, the average speed data $\overline{N}$ is calculated on the basis of two consecutive instantaneous speed data from the speed detecting unit 32 (see FIG. 4I). Numeral 34 denotes a target speed calculating unit which calculates a target idling speed corresponding to the operating condition of the diesel engine 3 at each instant in response to the coolant temperature data $D_T$ and outputs a target speed data $N_t$ representing the result of that calculation. The average value calculating unit 33 outputs the average speed data $\overline{N}$ representing the average speed of the diesel engine, and the target speed data $N_t$ and the average speed data $\overline{N}$ are added together in an adding unit 35 with the polarities as shown in FIG. 3. The result of this addition is derived as error data $D_e$, which is input to a first PID calculating unit 36 for performing data processing for PID control for error data $D_e$.

The result of the calculation performed in the first PID calculating unit 36 is derived as data $Q_{ci}$ with an injection amount dimension, which is applied through an adding unit 37 to a converting unit 38 to which the average speed data $\overline{N}$ is also input. Data supplied from the adding unit 37 is converted into control data D representing the target position of the fuel regulating member 16 which is necessary to reduce the content of the error data $D_e$ to zero.

As can be understood from the aforementioned description, the apparatus 1 has a closed loop control system responsive to the average speed data $\overline{N}$ and the target speed data $N_t$ for controlling the average idling rotational speed of the diesel engine 3 so as to coincide with the desired target value.

Although, in this embodiment, the average speed data $\overline{N}$ is calculated on the basis of the instantaneous speed data $N_{in}$ from the speed detecting unit 32, the average speed data $\overline{N}$ may be obtained by any conventional device.

The apparatus 1 has another closed loop control system for individual cylinder control, by which the fuel supplied to the engine is regulated for each of the cylinders so as to make the instantaneous engine speed for the respective cylinders equal. This closed control loop system comprises a speed difference calculating unit 39 which is responsive to the instantaneous speed data $N_{in}$ and sequentially and repeatedly calculates for every cylinder the difference between the instantaneous engine speed due to the output from each cylinder and that due to the output from a reference cylinder which is predetermined among the other respective cylinders. In this embodiment, the instantaneous engine speed obtained immediately prior to the instantaneous engine speed for a specific cylinder under consideration is selected as the reference instantaneous speed for the specific cylinder. Thus, the difference value $N_{ll}$–$N_{21}$, $N_{21}$–$N_{31}$, $N_{31}$–$N_{41}$, . . . are sequentially output from the speed difference calculating unit 39 as difference data $\Delta N_{in}$. In this embodiment, the speed difference calculating unit 39 has a shift register 40 and an adder 41. The shift register 40 receives the instantaneous speed data $N_{in}$ and stores only the last two instantaneous speed data in the series. The last two sequential data from the shift register 40 are input into the adder 41 in which these two data are added with the polarity shown in FIG. 3 to obtain the necessary difference data $\Delta N_{in}$ in sequence. The output timings and the contents of these difference data $\Delta N_{in}$ are shown in FIG. 4H.

The difference data $\Delta N_{in}$ is input to a second PID calculating unit 42 for performing a required process for PID control on the difference data $\Delta N_{in}$. Then, the second PID calculating unit 42 outputs individual cylinder fuel quantity data $Q_{ATC}$ representing the fuel quantity to be regulated for each cylinder in order to make the output from the respective cylinders the same and the individual cylinder fuel quantity data $Q_{ATC}$ is input to an output control unit 43. FIG. 4J shows the state in which the content of the calculated individual cylinder fuel quantity data $Q_{ATC}$ is renewed every 120(°CA).

The output control unit 43 serves to control the output timings of the individual cylinder fuel quantity data $Q_{ATC}$. These output timings are controlled, in accordance with the count signal TDCTR from the first timing detecting unit 27, as described in the following.

Assuming that the individual cylinder fuel quantity data $Q_{ATC}$ produced at any particular timing is obtained based upon the difference data $\Delta N_{in}$ relating to two of the cylinders $C_i$ and $C_{i+1}$, the individual cylinder fuel quantity data $Q_{ATC}$ is output before or during the subsequent fuel regulating stroke for cylinder $C_{i+1}$. In this case, the individual cylinder fuel quantity data $Q_{ATC}$ is output after 8 counted units of the count signal TDCTR. That is, the time slot for outputting the individual cylinder fuel quantity data $Q_{ATC}$ is shifted back in the output control unit 43 by 8 counted units of the count signal TDCTR.

The individual cylinder fuel quantity data $Q_{ATC}$ is provided through a switch 44 to the adding unit 37, and is added to data $Q_{ci}$ output from the first PID calculating unit 36 at that time, in the adding unit 37. The adding unit 37 is further input with a drive Q data $Q_{DR}$ from a target drive Q calculating unit 45. The target drive Q calculating unit 45 calculates a desired target drive fuel quantity corresponding to the condition of depression of the accelerator pedal 11, in response to the average speed data $\overline{N}$ and the acceleration data $D_A$, and outputs the data showing the result of the calculation as drive Q data $Q_{DR}$. The adding unit 37 adds together data $Q_{ATC}$, $Q_{ci}$ and $Q_{DR}$, and outputs data $Q_t$ representing the total sum.

As can be understood from the above-mentioned description, for example, the value $Q_{ll}$ of the individual cylinder fuel quantity data $Q_{ATC}$ represents the amount to which the fuel should be regulated in order to reduce to zero the difference between the instantaneous engine speed for the cylinder $C_6$ and the instantaneous engine speed for the cylinder $C_l$, that is, between the output from the cylinder $C_6$ and the output from the cylinder $C_l$. The individual cylinder fuel quantity data $Q_{ATC}$ with value $Q_{ll}$ is output during the period from 600(°CA) to 720(°CA) which is in the following fuel pressurization stroke in the cylinder $C_l$ and by which fuel injection in the next cylinder (cylinder $C_5$) is not influenced (refer to FIGS. 4J and 4K). In the same manner as described above, the operation for reducing the difference in output between the cylinders is sequentially carried out to reduce to zero the difference in output between cylinders $C_l$ and $C_2$, the difference between cylinders $C_2$ and $C_3$, the difference between cylinders $C_3$ and $C_4$, the difference between cylinders $C_4$ and $C_5$, and the difference between cylinders $C_5$ and $C_6$. In this way, control for regulating the fuel quantity is performed for each cylinder so as to make the output from the cylinders identical.

Furthermore, the switch 44, provided on the output side of the output control unit 43, is controlled so as to be set to the ON or OFF state by a loop control unit 46. The switch 44 is closed to perform individual cylinder control, only when the loop control unit 46 detects that predetermined conditions have been satisfied which indicate that individual cylinder control can be performed in a stable manner. 0n the other hand, if these predetermined conditions are not met, then, the switch 44 is opened to inhibit individual cylinder control from being carried out, thereby preventing instability of the idling operation resulting from individual cylinder control.

More specifically, for carrying out the control of the angular speed by the individual cylinder control, it is desirable that the idling rotational speed be in a stable condition in which the engine speed is within a predetermined speed range including a desired target value. This is because a good individual cylinder control operation is efficiently performed in the manner described above only if the change in the instantaneous engine speed resulting from deviation standards of the fuel injection system and the internal combustion engine occurs in a regular, periodic fashion. Consequently, if individual cylinder control should be carried out when an accelerating/decelerating operation is being carried out, or when some abnormality has arisen in the control system, the instability of the idling operation would become greater.

Therefore, in this embodiment, the switch 44 is closed to form the control loop for individual cylinder control only when the following conditions are all satisfied. Firstly, the coolant temperature must be greater than a predetermined value $T_r$. Secondly, the absolute value of the difference between the target idling engine speed and the actual idling engine speed must be maintained under a predetermined value $K_l$ for more than the predetermined time. Thirdly, the amount of depression $A_p$ of the accelerator pedal must be below a predetermined value $A_l$.

On the other hand, if a single one of the above conditions is not satisfied, the switch 44 will be opened and individual cylinder control will be terminated.

Moreover, since the condition of the control operation changes according to whether individual cylinder control is performed, it is possible to constitute the apparatus 1 so that the PID constant in the first PID calculating unit 36 and the second PID calculating unit 42 is changed in response to the open/closed state of the switch 44, thus enabling a much greater stabilization of the operation.

When the switch 44 is closed, data $Q_{ATC}$ is input to the adding unit 37 wherein the data $Q_{ATC}$ is added to both data $Q_{ci}$ and $Q_{DR}$, and a target injection amount data $Q_t$ to be used for individual cylinder control is output. The target injection amount data $Q_t$ is converted into target position data $P_t$ by the converting unit 38.

There is provided a correcting unit 47 for correcting the target position data $P_t$ so as to improve the response characteristics of the servo control operation carried out by the servo unit 18 in accordance with the target position data $P_t$. In this embodiment, the correcting unit 47 is provided on the output side of the converting unit 38 and has a correction calculating unit 48 which is responsive to the target position data $P_t$ and the average speed data $\overline{N}$, and calculates the amount of correction to be made to the target position data $P_t$ at that time in response to the control condition of the fuel injection amount supplied to the respective cylinders of the diesel engine 3.

The correction calculating unit 48 has a function for storing the target value $P_{t(n-1)}$ used in the fuel injection amount control operation carried out just before the fuel injection amount control operation for the cylinder currently being controlled and for calculating the difference data $\Delta P_t(=P_{tn}-P_{t(n-1)})$ which shows the difference between the target value $P_{tn}$ at this time and the last target value $P_{t(n-1)}$. Consequently, when $P_{tn}>P_{t(n-1)}$, the value of $\Delta P_t$ becomes positive and when $P_{tn}<P_{t(n-1)}$, the value of $\Delta P_t$ becomes negative. The value of the amount M of correction determined by the correction calculating unit 48 is calculated by mu1tiplying the target value $P_{tn}$ at that time by a correcting coefficient K whose magnitude is appropriately determined as a function of the average engine speed data $\overline{N}$ and the value of $\Delta P_t(=f(\Delta P_t, \overline{N}))$. The amount M of correction will have a positive sign if $\Delta P_t$ is positive while the amount M of correction will have a negative sign if $\Delta P_t$ is negative. Correction data $P_c$ representing the amount M of correction is output from the correction calculating unit 48.

In this embodiment, the correction calculating unit 48 has a shift register 60 and an adder 61. The shift register 60 receives the target position data $P_t$ and stores only the last two target position data in the series. The last two sequential target position data $P_{t(n-1)}$ and $P_{tn}$ from the shift register 60 are input into the adder 61 in which these two data are added with the polarity shown in FIG. 3 to obtain the difference data $\Delta P_t$. The output timing and the content of the difference data $\Delta N_{in}$ are shown in FIG. 4H.

The difference data $\Delta P_t$ is input to a map calculation unit 62 to which the average engine speed data $\overline{N}$ is input and the correcting coefficient K is calculated in the map calculation unit 62 in accordance with prescribed map data representing the function $f=(\Delta P_t,\overline{N})$. A signal representing the calculated correcting coefficient K is supplied to a multiplying unit 63 to which the target position data $P_t$ representing the target value $P_{tn}$ is input, and the multiplication of K and $P_{tn}$ is carried out in the multiplying unit 63. The result of the multiplication is output from the multiplying unit 63 as the correction data $P_c$, which is input to an adding unit 49 through a switch SW which is controlled to be opened/closed in response to the count signal TDCTR depending on whether the number represented by the count signal TDCTR is odd or even. The adding unit 49 is further input with the target position data $P_t$ directly from the converting unit 38. The target position data $P_t$ is added to the correction data $P_c$ by the adding unit 49 and the corrected data obtained as a result of this adding operation is output as the control data D.

The switch SW is closed when the value of TDCTR is an odd number, while it is opened when the value of TDCTR is an even number. Consequently, the content of the control data D becomes equal to the target position data $P_t$ when the value of TDCTR is an even number while the content of the control data D becomes equal to the sum of the target position data $P_t$ and the correction data $P_c$ when the value of TDCTR is an even number.

The operation of the correcting unit 47 will be described with reference to FIG. 5 in the following. FIG. 5A is a graph showing the pattern in change of the instantaneous speed of the diesel engine 3 while FIG. 5B is a graph showing pattern in change of the TDCTR value at this time. FIGS. 5A to 5B correspond to FIGS. 4B and 4F respectively. In the control unit 15, the calculation for the control is carried out at every occurrence of the pulses of the timing signal TS (FIG. 5C). FIG. 5D shows the pattern in the change of the value of the target position data $P_t$ which is calculated at each minimum point of the engine speed N. Meanwhile, the correction data $P_c$ is also calculated at the same time in synchronization with the aforementioned calculation of target data $P_t$ (see FIG. 5E). The correction data $P_c$ is added to the target position data $P_t$ supplied through the switch SW which operates in accordance with the content of the count signal, making the control data D as shown by the solid line in FIG. 5F.

As can be seen from FIG. 5F, since the correction data $P_c$ will be added on to the target position data $P_t$ immediately after the value of the target position data $P_t$ has been renewed, the target position supplied to the servo unit 18 becomes greater than the calculated target value if the difference $\Delta P_{tn}$ between the target value $P_{tn}$ this time and the previous target value $P_{t(n-1)}$ is a positive value. On the other hand, if the difference $\Delta P_{tn}$ is a negative value, the target position supplied to the servo unit 18 becomes less than the calculated target value. Consequently, the actual position of the fuel regulating member 16 varies as shown by the broken line in FIG. 5F by the control of the servo unit 18. The dot-dash line in FIG. 5F illustrates the pattern in the change of the actual position of the fuel regulating member 16 in the case where the correction data $P_c$ is not used at all. As can be seen from comparing the two operations, the response characteristic of the servo control by the servo unit 18 is improved by the use of correction data $P_c$. When the value of TDCTR becomes even after the fuel regulating member 16 has been quickly moved to the desired target position shown by the target position data $P_t$, the data D becomes equal to the target position data $P_t$ and the desired positioning of the fuel regulating member 16 can be determined before fuel injection starts.

In this case, since the value of the correction data $P_c$ is determined in accordance with the average engine speed, and the magnitude of $\Delta P$, which represents the difference between the target position of the previous time and that of this time, the response characteristics of the servo system can be set in a suitable condition at all times and a good servo control is ensured. Therefore, even when the idling rotational speed of the engine has become high and the period of the TDC pulse signal has become short, the fuel regulating member 16 can be positioned at the desired target position without fail before the fuel injecting operation for a specific cylinder under consideration is started.

A description of the operation of the idling operation control apparatus 1 shown in FIGS. 1 and 3 will now be given. The fuel amount regulating operation is carried out by the servo unit 18 according to the closed loop control which is executed in response to the data $\overline{N}$ showing the average speed of the diesel engine 3 and the target speed data $N_t$. As a result, the amount of fuel injection is controlled in such a way that the average idling rotational speed of the diesel engine 3 is maintained at a speed shown by the target speed data $N_t$. When the idling rotational speed is kept in a substantially stable condition and the desired conditions are satisfied, the switch 44 is closed by the loop control unit 46 and the individual cylinder fuel quantity data $Q_{ATC}$ for individual cylinder control is input to the adding unit 37 through the switch 44. Thus, the individual cylinder fuel quantity data $Q_{ATC}$ for individual cylinder control is supplied to the closed loop control system at the required timing by the output control unit 43.

The individual cylinder fuel quantity data $Q_{ATC}$ is obtained in accordance with the movement of the crankshaft 4 within a predetermined measuring period which is set so as to include, of the period during which torque is produced due to fuel combustion in the cylinder concerned, at least that part during which no influence arises because of torque produced in cylinders other than the cylinder concerned. Therefore, it is possible to obtain data related to the output of the specific cylinder under consideration with minimum influence being received from the output from the other cylinders. As a result, a stable operation of the individual cylinder control in the idling operation can be expected.

The target injection amount data $Q_t$ is converted into the target position data $P_t$ by the converting unit 38 and the target position data $P_t$ is corrected by the correcting unit 48. This correction is carried out by adding the amount M for correction to the target position data $P_t$ only in the case where the value of TDCTR is an odd number. As a result, the response characteristics of this control system are improved as aforementioned (refer to FIGS. 5A to 5F).

The same function as that of the control unit 15 described above can be realized by executing an appropriate control program in a microcomputer, and an apparatus with this type of constitution comes within the scope of the present invention.

Figure 6:
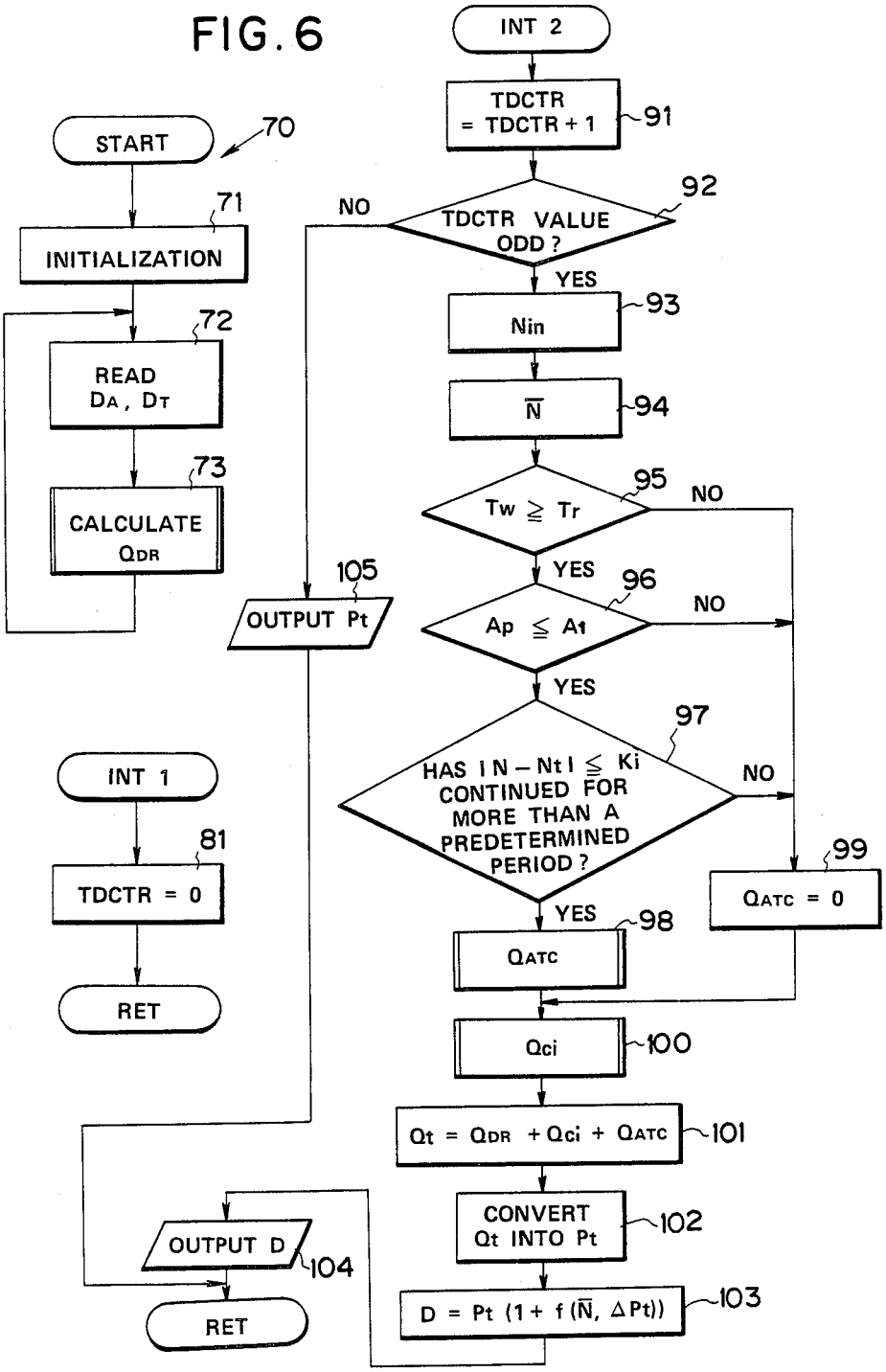
FIG. 6 is a flowchart showing a control program for execution by a micrcomputer for realizing the same function as that of the control unit shown in FIG. 3.

FIG. 6 is a flowchart showing a control program to be executed in a microcomputer for realizing a similar control function to that of the control unit 15 shown in FIG. 1. This control program will be explained on the basis of this flowchart in the following. This control program comprises a main control program 70 and two interrupt programs INT 1 and INT 2. The main control program 70, which is for calculating the drive Q data $Q_{DR}$, has a step 71 in which operation is initialized after which the operation moves to step 72 where acceleration data $D_A$ and the coolant temperature data $D_T$ are read in. The procedure then moves to step 73 wherein the drive Q data $Q_{DR}$ is calculated on the basis of the acceleration data $D_A$ and the average speed data $\overline{N}$ obtained in the interrupt program INT 2 to be described below.

The interrupt program INT 1 is executed every time a lift pulse signal NLP is generated. When the execution of the interrupt program INT 1 starts, the variable TDCTR representing the counted value of a counter formed by software, is reset in step 81 and the procedure returns to the main program 70.

The interrupt program INT 2 is executed every time one of the pulses of the top dead center pulse signal TDC is produced. When the execution of the interrupt program INT 2 starts, the operation firstly goes to step 91 where the value of TDCTR is incremented by one and then to step 92 wherein discrimination is made as to whether the value of TDCTR is odd or not. When the value of TDCTR is odd, the result of the discrimination in step 92 becomes YES and the procedure moves on to step 93 where data $N_{in}$ is calculated. As can be seen from FIG. 4, the data $N_{in}$ calculated at this time is data for a cylinder whose combustion stroke commenced 120(°CA) earlier. The operation then proceeds to step 94 where the average speed data $\overline{N}$ showing the average engine speed at that time is calculated from the data $N_{in}$ obtained in step 93 and data $N_{i(n-1)}$ obtained prior to data $N_{in}$.

In the following steps 95 to 97, it is discriminated whether the coolant temperature $T_w$ is higher than a predetermined value $T_r$, whether the amount $A_p$ of depression of the accelerator pedal 11 is not more than a predetermined value $A_1$, and whether the absolute value $|\overline{N}-N_t|$, which is the difference between the target idling rotational speed $N_t$ and the average idling rotational speed $\overline{N}$, has been below the value $K_i$ for longer than a predetermined period. Only when the results of the discrimination in all of the steps 95 through 97 are YES, does the operation move on to step 98 where the individual cylinder fuel quantity data $Q_{ATC}$ for individual cylinder control is calculated. On the other hand, if the result of the discrimination is NO in any of the steps 95 to 97, the operation moves to step 99 where the content of the data $Q_{ATC}$ is set to zero, so that no individual cylinder control is carried out.

After either step 98 or 99 has been carried out, the operation moves to step 100 where data $Q_{ci}$ is calculated for controlling the average idling engine speed on the basis of the coolant temperature data $D_T$. After this, the procedure moves to step 101 where data $Q_t$ showing the amount of fuel injection required for each instant is calculated. The data $Q_t$ is equal to the total sum of data $Q_{DR}$, $Q_{ci}$ and $Q_{ATC}$. The value of $Q_{ATC}$ at this time is the value which was calculated at the time when the value of TDCTR was 8 units less than the present TDCTR value, that is, at the time 480(°CA) earlier. In the next step 102, the data $Q_t$ is converted into target position data $P_t$ showing the position of the fuel regulating member 16 necessary for obtaining the amount of fuel injection shown by data $Q_t$ with reference to the average speed data $\overline{N}$. The operation then moves to step 103 where the target position data $P_t$ is corrected by being multiplied by $1+f(\overline{N}, \Delta P_t)$ to obtain control data D which has been corrected. The operation then moves to step 104 wherein this corrected control data D is output.

When the result of the discrimination in step 92 is NO, that is, during the period from the maximum point to the minimum point of the instantaneous engine speed N as can be seen from FIG. 4, steps 93 through 104 are not carried out and the operation moves to step 105 wherein data $P_t$ obtained one program cycle before is output as it is and the execution of the interrupt program INT 2 is terminated.

Thus, the positioning operation of the fuel regulating member 16 can be carried out with high response characteristics. Furthermore, even when the idling rotational speed of the engine has become high and the period of the TDC pulse signal has become short, the fuel regulating member 16 can be positioned at the desired target position without fail before the fuel injecting operation for a specific cylinder under consideration is started.

FIG. 7 shows a detailed flowchart of the calculation step 98 of $Q_{ATC}$ shown in FIG. 6. This detailed flowchart will be explained in the following. Firstly, in step 111, the difference data $\Delta N_{in}$ is calculated, which shows the difference between data $N_{in}$ obtained in step 93 of this program cycle and data $N_{i(n-1)}$ obtained in step 93 of the previous program cycle. The procedure then moves on to step 112 where the difference $\Delta\Delta N_i$ between the difference data $\Delta N_{in}$ obtained in step 111 and the difference data $\Delta N_{i(n-1)}$ obtained in the same manner at a time one cycle before is calculated. After this, the operation moves to step 113 wherein the individual constants for PID control are set and then to step 114 where the integral term $I_{ATCi}$ is loaded. The procedure then moves to step 115 where a PID control calculation is carried out and further to step 116 wherein the control data $Q_{ATC}$ for individual cylinder control obtained as a result of step 115 is stored in a RAM in relation to the TDCTR value at this time.

According to the above-mentioned control program, the content of the TDCTR reset by the occurrence of a lift pulse signal NLP is incremented every time a pulse of a top dead center pulse signal arises. Moreover, only when TDCTR is an odd number is calculation carried out for the instantaneous speed of rotation of the crankshaft according to the torque arising in each cylinder, resulting in individual cylinder control being carried out. Consequently, as already stated, data $N_{in}$ is calculated on the basis of the rotation of the crankshaft 4 during a predetermined measurement period determined so as to include that part of the period during which torque is produced due to fuel combustion in a specific cylinder during which no influence arises because of torque produced in cylinders other than the specific cylinder. As a result, it is possible to produce data relating to the output of each cylinder where influence from the output of other cylinders is suppressed to the minimum and also to carry out individual cylinder control of the idling operation with stability.

The present embodiment relates to a case in which the present invention is applied to the idling operation control of a 4-cycle 6-cylinder type diesel engine. However, the present invention is not limited only to the construction of the present embodiment, but can also be applied to the idling operation control of a multi-cylinder internal combustion engine of a type other than the internal combustion engine represented in the embodiment, such as an internal combustion engine with more than four cylinders.

In this embodiment, since the measuring period for obtaining data related to the output from each cylinder is set as aforementioned, a comparatively accurate detection is possible of the output of each cylinder with the influence by the output from other cylinders being suppressed. Thus, it is possible to realize an accurate control of the amount of injection for every cylinder during the idling operation of the internal combustion engine and to carry out the idling operation with extreme stability.

I claim:

1. An apparatus for controlling the idling operation of a multi-cylinder internal combustion engine which performs individual cylinder control for reducing the difference in output among the cylinders of the engine, said apparatus comprising:

a fuel regulating member for adjusting the quantity of a fuel to be supplied to the internal combustion engine;

a first detecting means for detecting the operation timing of the internal combustion engine;

a first calculating means for calculating and producing a first data relating to the output from each cylinder of the internal combustion engine;

a second calculating means responsive to the first data for calculating and producing an individual cylinder control data related to the supply of fuel necessary for reducing to zero the difference between the output from each cylinder and the output from a reference cylinder which is predetermined for the respective cylinders;

an output control means for controlling each output timing of the individual cylinder control data in response to the result of the detection by said first detecting means so that the individual cylinder control data is produced at a predetermined timing before the next fuel regulating process for the cylinder corresponding thereto;

a correcting means for correcting the individual cylinder control data from said output control means only during a predetermined correction period before said next fuel regulating process for the cylinder corresponding to said individual cylinder control data, said correcting means having means for obtaining difference data representing a difference between the last two consecutive individual cylinder control data, means responsive to the difference data and data representing an average speed of the engine for determing a correction coefficient, and means for determining the amount of correction in response to the correction coefficient and the last individual cylinder control data to provide corrected individual cylinder control data for quickly moving said fuel regulating member toward a target position which is greater or less than a desired position corresponding to said last individual cylinder control data; and, a servo means reponsive to said corrected individual cylinder control data for quickly adjusting said fuel regulating member to said desired position such that the fuel quantity to be supplied to the internal combustion engine corresponds to said last individual cylinder control data, said predetermined correction period providing sufficient time for said adjustment to be completed before said next fuel regulating process for the cylinder corresponding to said last individual cylinder control data.

2. An apparatus as claimed in claim 1 wherein said first detecting means has a first signal generator for generating first pulses every time a crankshaft of said engine reaches predetermined reference angular positions, a second signal generator for generating second pulses every time fuel is injected into a predetermined cylinder of said engine, and a data output means responsive to said first and second pulses for producing discrimination data indicating which cylinder is in the combustion process.

3. An apparatus as claimed in claim 2 wherein said first signal generator generates the first pulse every time any of the pistons of said engine reaches its top dead center position.

4. An apparatus as claimed in claim 2 wherein said second signal generator is a lift sensor which is provided on a fuel injection nozzle mounted on the predetermined cylinder and produces the second pulses in response to the injecting operation of the fuel injection nozzle.

5. An apparatus as claimed in claim 2 wherein said data output means is a counting means which is reset in response to the second pulses and conts the number of input first pulses, and the result of the count is produced as the discrimination data.

6. An apparatus as claimed in claim 5 wherein said engine is a 4-cycle engine having more than four cylinders.

7. An apparatus as claimed in claim 1 wherein said apparatus further comprises a second detecting means responsive to an output from said first detecting means for producing a timing signal for determining a predetermined measurement period for each cylinder, and said first calculating means calculates the first data in response to the timing signal.

8. An apparatus as claimed in claim 7 wherein said second detecting means determines the predetermined measurement period so as to include at least that part during which torque is produced due to fuel combustion in a cylinder concerned during which no influence arises because of torque produced in cylinders other than the specific cylinder concerned.

9. An apparatus as claimed in claim 5, further comprising a second detecting means responsive to an output from said first detecting means for producing a timing signal for determining a predetermined measurement period for each cylinder which includes at least that part during which torque is produced due to fuel combustion in a cylinder concerned during which no influence arises because of torque produced in cylinders other than the specific cylinder concerned.

10. An apparatus as claimed in claim 9 wherein said second detecting means has a discriminator responsive to the discrimination data for discriminating whether or not the result of the count by said data output means is an odd number, and means responsive to the first pulses and the output of the discriminator for selectively outputting the first pulses in accordance with the result of the count of said data output means.

11. An apparatus as claimed in claim 7 wherein said first calculating means calculates data relating to the angular velocity of the crankshaft of the engine during the measurement period.

12. An apparatus as claimed in claim 1 wherein said correcting means corrects the individual cylinder control data output from said output control means.

13. An apparatus as claimed in claim 1 wherein the amount of correction calculated is added to the last individual cylinder control data only during the predetermined correction period.

14. An apparatus as claimed in claim 5 wherein the amount of correction calculated is added to the last individual cylinder control data only during the predetermined correction period.

15. An apparatus as claimed in claim 14 wherein the predetermined correction period is determined in accordance with the output result of the counting means.

16. An apparatus as claimed in claim 14 wherein the amount of correction calculated is added to the last individual cylinder control data only when the output result of the counting means is an odd number.

17. An apparatus as claimed in claim 1 further comprising means for determining said predetermined correction period in accordance with the result of the detection by said first detecting means.

18. An apparatus as claimed in claim 1 wherein said predetermined correction period decreases as the idling speed of said engine increases.

19. An apparatus as claimed in claim 1 wherein said predetermined correction period decreases with decrease in the interval of crank shaft angle between the start of combustion in one cylinder and the star of combustion in the next cylinder.

20. An apparatus as claimed in claim 19 wherein said engine has at least six cylinders.

* * * * *

UNITED STATES PATENT AND TRADEMARK OFFICE

CERTIFICATE OF CORRECTION

PATENT NO. : 4,779,595

DATED : October 25, 1988

INVENTOR(S) : Fujimori, Kyoichi

It is certified that error appears in the above-identified patent and that said Letters Patent is hereby corrected as shown below:

In column 15, line 66, change "conts" to --counts--.

In column 16, line 64, change "star" to --start--.

Signed and Sealed this

Twenty-first Day of March, 1989

*Attest:*

*Attesting Officer*

DONALD J. QUIGG

*Commissioner of Patents and Trademarks*